United States Patent [19]

Evenson

[11] Patent Number: 4,659,293

[45] Date of Patent: Apr. 21, 1987

[54] PUMPING SYSTEM WITH AIR CONVEYANCE AND METHOD

[75] Inventor: William R. Evenson, South Houston, Tex.

[73] Assignee: Lefco Western, Inc., Houston, Tex.

[21] Appl. No.: 784,545

[22] Filed: Oct. 4, 1985

Related U.S. Application Data

[63] Continuation of Ser. No. 629,815, Jul. 11, 1984, abandoned, which is a continuation-in-part of Ser. No. 602,927, Apr. 23, 1984, Pat. No. 4,613,290.

[51] Int. Cl.[4] ..... F04B 17/06

[52] U.S. Cl. ..... 417/231; 417/517; 417/900; 141/231; 406/166; 406/168

[58] Field of Search ..... 417/900, 519, 516, 517, 417/532, 231, 234; 406/109, 115, 166, 168; 141/231

[56] References Cited

U.S. PATENT DOCUMENTS

| | | | |
|---|---|---|---|
| 2,917,344 | 12/1959 | Futty | 406/109 |
| 3,279,383 | 10/1966 | Smith | 417/234 |
| 3,884,528 | 5/1975 | Shaddock | 406/115 |

*Primary Examiner*—Carlton R. Croyle
*Assistant Examiner*—Theodore W. Olds
*Attorney, Agent, or Firm*—Brady, O'Boyle & Gates

[57] ABSTRACT

A high volume long distance pumping system for heavy sludges and contaminated flowables utilizes a blower powered air conveyance arrangement to draw solids and air from an available source and deliver the mixture through a hose to a separator from which extracted liquids and solids enter a closed tank hopper while air from the separator is filtered and exhausted through the blower to atmosphere. The liquid/solids mixture in the closed tank hopper is delivered by a piston pump in communication with the tank hopper through a discharge line to a point of consumption or storage.

2 Claims, 4 Drawing Figures

AIR
AIR + SOLIDS
SOLIDS

PUMPING SYSTEM WITH AIR CONVEYANCE AND METHOD

CROSS-REFERENCE TO RELATED APPLICATION

This is a continuation, of application Ser. No. 629,815, filed July 11, 1984, now abandoned, which is a continuation-in-part of prior copending application Ser. No. 06/602,927, filed Apr. 23, 1984, for EVACUATED PUMPING SYSTEM, now U.S. Pat. No. 4,613,290.

BACKGROUND OF THE INVENTION

The above prior application discloses and claims an improvement in pumping systems of the type shown in U.S. Pat. No. 4,337,017. Such pumping systems for viscous materials and semisolids can become sluggish and inefficient depending on the nature of the material being pumped and other variables. This is particularly true with open hopper systems of the type shown in U.S. Pat. No. 4,337,017.

In the above-referenced application, the pumping system for flowables has its operational efficiency greatly increased by utilizing a closed tank hopper for material being pumped in communication with an external suction source which maintains a constant partial vacuum in the tank hopper, enabling its rapid filling during operation of the system, and substantially relieving the dual alternating piston pump of the task of sucking material into a tank hopper and also pumping the material through a delivery line to a point of consumption or storage. In effect, the improvement according to the referenced patent application allows the energy of the piston pump to be utilized almost entirely for the positive pumping and delivery of the material to the point of consumption or storage.

The present invention is a further improvement on pumping systems for heavy sludges, slurries and contaminated flowables utilizing air conveyance of such materials, from a convenient source, to a separator, where solids and liquids are separated from the conveying air and delivered to a closed and sealed tank hopper, which is maintained under some degree of vacuum by operation of the conveyance system. A dual alternating piston pump is used to pump the separated liquid and solids mixture from the tank hopper through a discharge line to a point of consumption or storage. The improved system, to a great extent, possesses the advantages of the system in the referenced application, and additionally can be employed to handle flowables of much greater viscosity than the prior art systems. The improved system, according to this invention, can pump materials through greater distances, up to a mile. The pumping distance is directly proportional to the friction of the material.

In the system of the referenced patent application, good efficiency is obtained if the material being handled is of a readily flowable nature and if there are no significant leaks of air into the system while pumping the material. If there are any significant air leaks, the material being sucked in will tend to lie in the suction line while air passes around it. The intake end of the suction hose must be completely submerged. These limitations are not present in this invention utilizing air conveyance for a wide variety of liquids and solids sucked from remote ponds or the like into a separator and a closed tank hopper, for efficient pumping to remote points of consumption or storage.

The basic reason for employing air conveyance of materials is to eliminate using shovels or scoops to fill the tank hopper. In the present invention, as well as the referenced prior application, the closed tank hoppers are maintained full of material during pumping. It is also easier to pick up wet material by a suction process rather than by shoveling or scooping.

The air conveyance arrangement according to the present invention can lift a flowable material as high as 200 feet vertically, whereas the suction system in the referenced application can lift similar material only about 28 feet. The air conveyance system can suck up much stiffer material because entraining air is also sucked in at all times. Dry sand, for example, can be sucked in and conveyed by the present invention, and such material could not be conveyed effectively by the system in the referenced application.

Other features and advantages of the present invention over the prior art will become apparent during the course of the following description.

DETAILED DESCRIPTION

Figures 1, 2, 3:
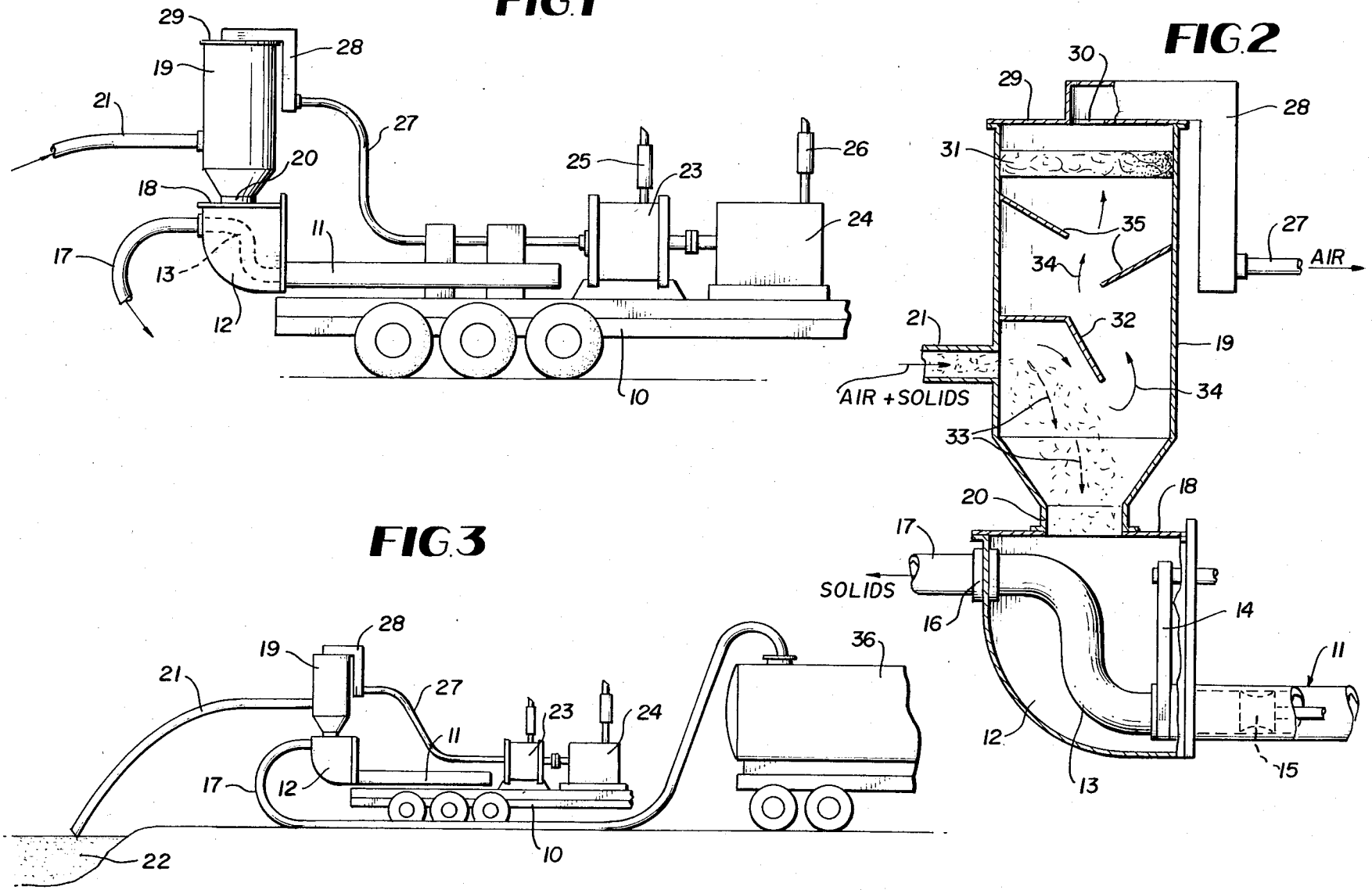
FIG. 1 a fragmentary side elevation of a trailer-mounted pumping system with air conveyance according to the present invention.
FIG. 2 is an enlarged vertical section taken through a separator and closed tank hopper and associated elements, partly in elevation.
FIG. 3 is a side elevation on a reduced scale of a complete pumping and material transport system in accordance with the invention.

Referring to the drawings in detail wherein like numerals designate like parts, and referring first to FIGS. 1 and 2, a wheeled trailer 10 or another suitable support serves to mount a horizontal axis dual alternating piston pump 11 of the type shown in U.S. Pat. No. 4,337,017 and in the referenced prior pending application. A closed and sealed tank hopper 12 for material being pumped to a consumption or storage location is attached securely to the pump 11, as disclosed in the prior art. An oscillating elbow conduit 13 within the tank hopper 12 is swung by a crank arm 14 into alternating registration and communication with the two cylinders of the pump 11, each of which contains a pumping piston 15, as described in the prior art. The other end of the elbow conduit 13 has a swiveled fluid tight connection at 16 with a pumped material delivery line 17, such as a six inch diameter hose of sufficient length to pump heavy sludges and slurries contaminated with solids, such as rocks and rags, for distances up to a mile from the location of the pumping system.

Securely mounted upon a sealed tank hopper cover plate 18 is an upright axis separator 19 for conveying air and entrained solids and liquids. A lower end neck 20 of the separator 19 is secured in open communication with the interior of the tank hopper 12. An inlet suction line 21, such as an eight inch diameter flexible hose, of appropriate length is connected into the side of the separator 19 well above its neck 20. The far end of the hose 21, as depicted in FIG. 3, can be placed in a pond 22 containing sludge or the like requiring pumping. The end of the hose 21 should not be completely submerged in the pond so that conveying air, as well as liquid and solids, may be sucked through the hose into the separator 19. If desired, a flotation collar, not shown, may be applied to the hose 21 to position its open end properly with relation to the surface of the pond 22.

The mixture of the slurry from the pond 22 and conveying air is sucked into the separator 19 by the action of a large blower 23 on the trailer 10, driven by an engine 24, the blower and engine having exhaust pipes 25 and 26. The blower sucks air through an air suction hose 27 connected between the blower inlet and an air exhaust manifold 28 atop the separator 19 and connected with a sealed cover plate 29 of the separator, having an exhaust port 30 leading into the manifold 28. The exhausting air passes through a filter 31 contained near the top of the separator 19 before entering the manifold 28.

Within the separator 19 in alignment with the suction hose 21 is a target plate or baffle 32 which is inclined and located near the center of the separator. This plate deflects all solids and liquid downwardly through the neck 20 and into the tank hopper 12 during the operation of the system to maintain the tank hopper filled with the sludge or contaminated liquid or semiliquid being pumped. The downward flow of solids and liquid is depicted by the arrows 33 in FIG. 2. The separated conveying air is sucked upwardly by the blower 23 in the separator 19, as shown by the arrows 34. Such air blows around the target plate 32 and between spaced baffle plates 35 within the separator above the target plate. After passing through the filter 31, the conveying air is exhausted through the manifold 28, hose 27 and blower 23. It is this continuous flow of air through the blower which creates the air conveyance feature of the invention. The liquid and solids are entrained in the conveying air passing continuously through the system, as described.

The blower suction conveyance system also maintains a negative pressure in the closed tank hopper 12, thereby obtaining to a certain degree the advantages of the system in the referenced patent application. Another major advantage of the air conveyance of liquids and solids compared to the suction pump of the referenced application is that the air system is capable of lifting material as much as 200 feet vertically. The suction pump of the prior application is limited to lifting water approximately 27 feet vertically and only with a nearly perfect vacuum.

Referring to FIG. 3 showing the pumping system above-described, the delivery hose 17 for pumped material is extended to a tanker truck 36 which can transport the sludge or the like to any destination. The hose 17 can be connected to a stationary storage tank or may lead to diverse distant points of consumption, not shown.

Figure 4:
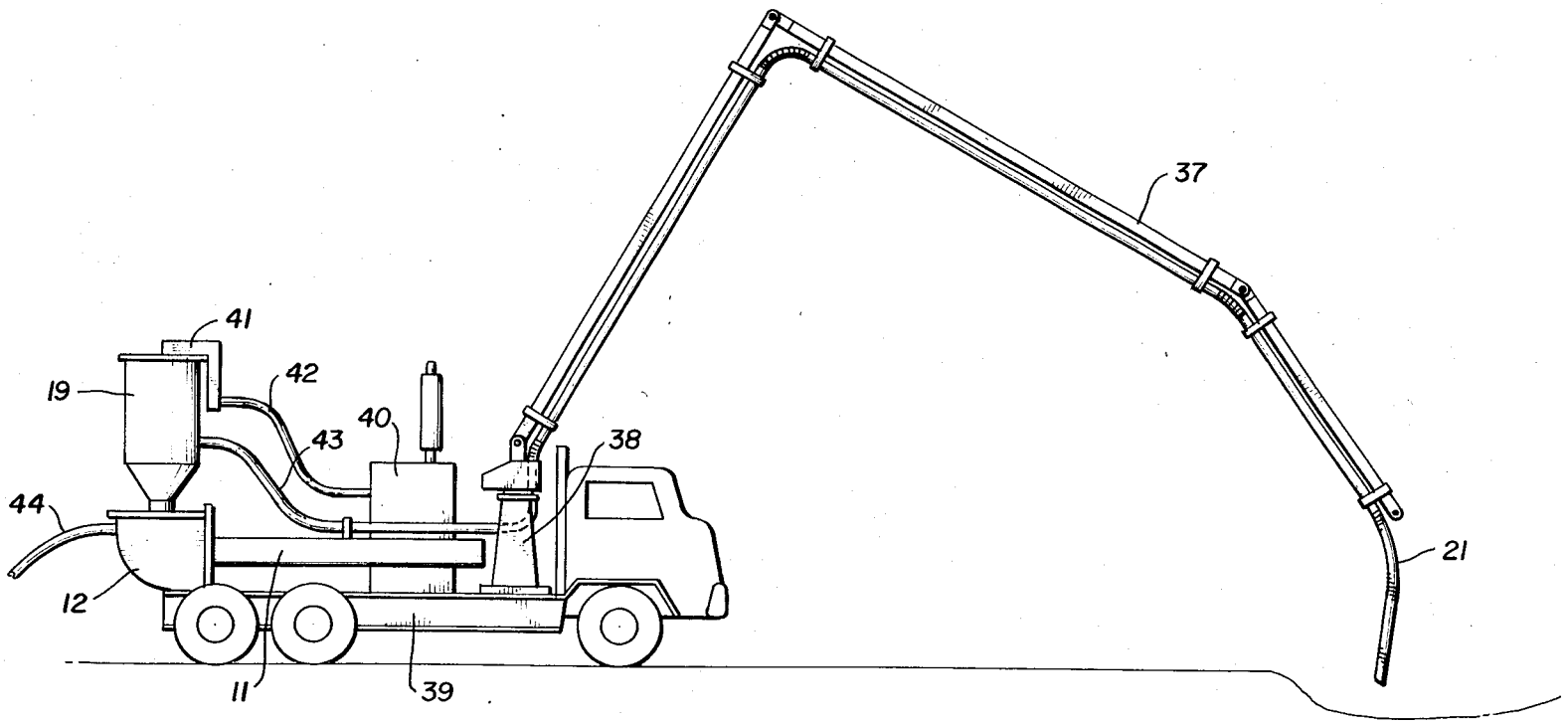
FIG. 4 is a side elevation of a vehicle mounted pumping system according to a modification of the invention which utilizes a three stage articulating boom for the support of a large suction line.

Referring to FIG. 4, because of the ability of the air conveyance system to pull material for longer distances, the inlet suction line 21 is supported by a three section articulated boom 37 carried by a vehicle mounted pedestal 38 and having conventional controls within the cab of a transport vehicle 39 for the system.

The described separator 19 and closed tank hopper 12 along with the dual alternating piston pump 11 are mounted on the rear of the vehicle. A blower 40 is centrally mounted on the vehicle and pulls exhausted air from the top of the separator through an exhaust manifold 41 and air suction hose 42 leading to the blower 40 exactly as described previously in FIGS. 1–3.

An extension 43 of the material suction line 21 leads from the articulated boom to the intake of the separator 19 exactly as described previously for the suction line 21. A pumped material delivery hose 44 similar to the previously-described hose 17 delivers pumped sludge or the like to a remote location of consumption or storage. The mode of operation of the system shown in FIG. 4 is identical to and possesses the stated advantages of the system shown and described relative to FIGS. 1 through 3.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A mobile pumping system for sludges and like flowables comprising a vehicular support, a closed tank hopper on the vehicular support, a dual cylinder alternating piston pump connected with the closed tank hopper and being operable to pump material therefrom, an elongated flexible delivery conduit connected with the closed tank hopper and extending therefrom to a remote point of consumption or storage for material being pumped from the tank hopper, an adjustable articulated multi-section boom on the vehicular support, an elongated flexible suction conduit carried by the articulated boom and including a portion extending forwardly of the leading end of the boom adapted to be placed in a remote supply of a flowable requiring pumping, said suction conduit including a rear extension, an upright axis gravity-assisted separator unit mounted on top of the closed tank hopper and being in communication therewith through the bottom of the separator unit and the top of the tank hopper, said rear extension of the suction conduit being connected into the side wall of the separator unit near the bottom thereof, an air blower mounted on the vehicular support and being separated from said pump, closed tank hopper and said separator unit, and another suction conduit means connected between the top of the separator unit and an inlet of said air blower, whereby the air blower maintains a partial vacuum in the closed tank hopper to promote the filling thereof while easing the operation of the dual cylinder alternating piston pump in pumping material from the tank hopper.

2. A mobile pumping system for sludges and like flowables as defined in claim 1, and separator baffles within the separator unit and a filtering means therein above the connection of said rear extension of the first-named suction conduit with the separator unit.

* * * * *